US005469870A

United States Patent [19]

Meador

[11] Patent Number: 5,469,870

[45] Date of Patent: Nov. 28, 1995

[54] SECONDARY SMOKE FILTRATION DEVICE

[76] Inventor: Murray P. Meador, 104 Ryburn Ct., Old Hickory, Tenn. 37138

[21] Appl. No.: 198,380

[22] Filed: Feb. 18, 1994

Related U.S. Application Data

[63] Continuation of Ser. No. 960,924, Oct. 13, 1992, abandoned.

[51] Int. Cl.[6] ..... A24F 13/06

[52] U.S. Cl. ..... 131/187; 131/202; 131/329

[58] Field of Search ..... 131/187, 189, 131/329, 330, 175, 190, 201, 202, 213, 218

[56] References Cited

U.S. PATENT DOCUMENTS

| | | | |
|---|---|---|---|
| 2,284,176 | 5/1942 | Stebner | 131/330 |
| 4,148,328 | 4/1979 | Fox | 131/187 |
| 4,200,114 | 4/1980 | Waite | 131/187 |
| 4,637,407 | 1/1987 | Bonanno et al. | 131/187 X |
| 4,790,332 | 12/1988 | Wallace . | |
| 4,807,646 | 2/1989 | Sahar | 131/330 |
| 4,899,766 | 2/1990 | Ross, Jr. . | |
| 4,993,435 | 2/1991 | McCann . | |
| 5,048,545 | 9/1991 | Takagi et al. | 131/330 |

*Primary Examiner*—Jennifer Bahr
*Attorney, Agent, or Firm*—Laubscher & Laubscher

[57] ABSTRACT

A secondary-smoke filtration device which effectively filters one-hundred percent of the secondary-smoke associated with cigarettes, pipes, and cigars. The device includes a smoked product container (20), an exhalation pipe (34), a smoke conduit (30), and a filtering device (45). In use, the smoker inhales smoke from the smoked product (10) contained within the smoked product container (20) and exhales into the exhalation pipe (34). The smoke is drawn through the smoke conduit (30) by a blower fan (64) and through a series of filters (59), (60) and (61), respectively. The smoke is then returned to the environment free of contaminants and pollutants.

10 Claims, 4 Drawing Sheets

FIG. 1
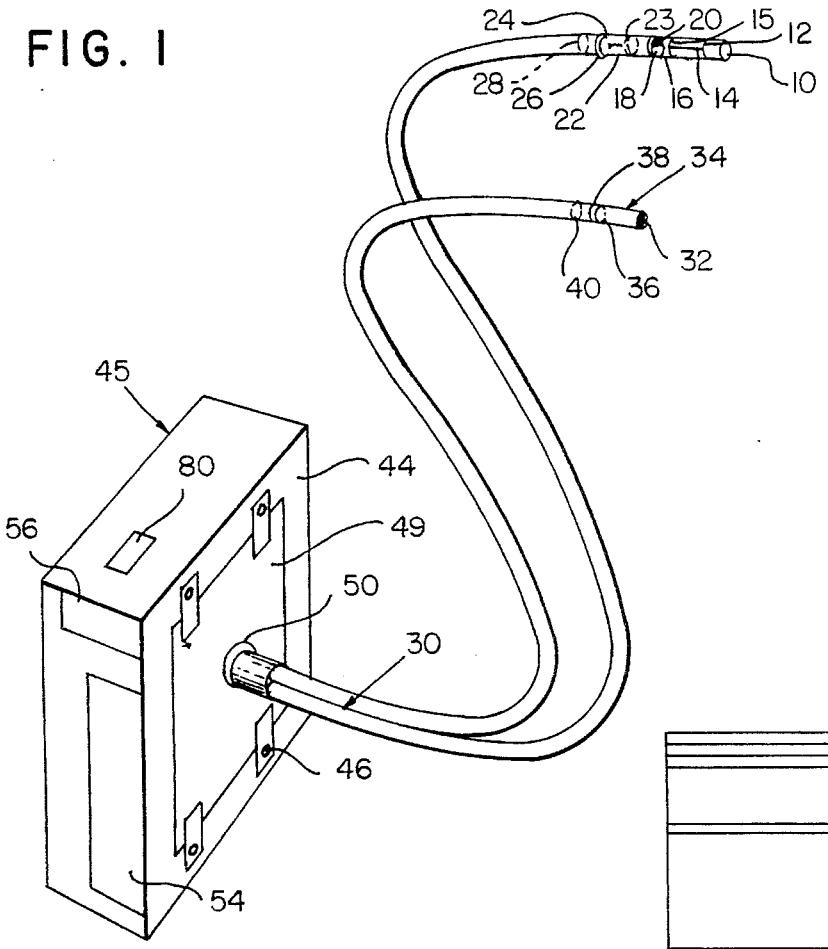
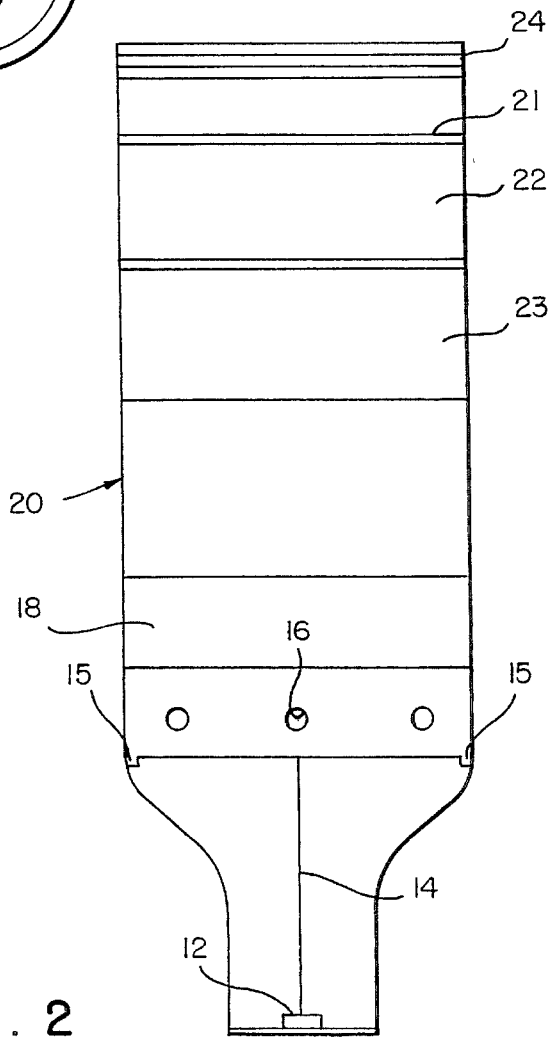
FIG. 2

SECONDARY SMOKE FILTRATION DEVICE

This application is a continuation of application Ser. No. 07/960,924, filed Oct. 13, 1992, now abandoned.

BACKGROUND—FIELD OF INVENTION

This invention relates to devices for filtering the secondary-smoke of cigarettes, pipes, and cigars.

BACKGROUND—DESCRIPTION OF PRIOR ACT

One of the major problems within society today is the existence of cigarette, pipe, and cigar smoke. Moreover, it is the presence of "secondary-smoke"; that smoke which is both exhaled from the mouth of a smoker and which eminates from the lit end of a smoked product, that is the source of this problem.

The problem of secondary-smoke affects two parties: smokers and non-smokers. On one hand, non-smokers are physically put at risk by being subjected to the secondary-smoke of others. Secondary-smoke contains nicotine, carbon monoxide, and other carcinogenic agents. In fact, it is estimated that 38,000 lung cancer deaths, as well as 10,000 non-lung cancer deaths, occur yearly as a result of secondary-smoke. Further, between 35,000 and 40,000 deaths per year can be attributed to heart and blood vessel damage as a result of secondary-smoke inhalation. Even more disturbing is the link between secondary-smoke and increases in the respiratory failures of children. Also, many non-smokers are discomforted by the odor of cigarette, pipe, and cigar smoke, as well as by the irritation they experience when this smoke comes into contact with their eyes.

However, past attempts to curb secondary-smoke have come at the expense of the smokers themselves. Numerous laws and regulations have been enacted in an attempt to stop public smoking. For example, federally, laws have been passed banning smoking on all domestic airline flights. On the state level, laws have been enacted which restrict smoking in hospitals, schools, libraries, and various other public places. Even on the private level, many institutions have set up policies which effectively make them "non-smoking" facilities.

The results of these actions have become all too familiar. Long waits in restaurants for the "smoking-section"; the bathroom-smoking flyer who is now labeled a criminal; the groups of smokers huddled outside businesses on wintry days; these are but a few examples. As a result of these restrictions, smokers as a group have lost the right to freely smoke in public.

The solution to this problem lies in a device that will not only protect the health and comfort of non-smokers, but which will also enable smokers to freely smoke, unfettered by the constraints of public smoking regulations. The solution is to be found in a device that functionally filters one-hundred percent of the secondary-smoke of cigarettes, pipes, and cigars, yet does not limit the mobility the smoker is accustomed to nor infringe on their pleasure and satisfaction.

Nevertheless, all the prior secondary-smoke filtering devices heretofore known have been incapable of satisfying both smokers and non-smokers. Past attempts have failed to solve the problem and their disadvantages are clear.

The device in Ross, Jr.'s U.S. Pat. No. 4,899,766, issued Feb. 13, 1990, is cumbersome to use, is relatively inflexible in regards to its ease of use with different-sized smoked products, and employs unnecessary component parts. In order to operate the device, a certain precision is required that adversely affects the effectiveness and operability of the device in actual practice. Also, there is an obvious difficulty in regards to the installation of the smoked product as a result of the device's inadequate design. For example, if the container of the smoked product is small enough to actually secure a cigarette in place, for instance, then breakage or damage of the cigarette is highly likely, if the cigarette can be installed at all. Conversely, if ease of installation is facilitated, then there is no way to actually hold the cigarette securely in place. Also, there is limited flexibility within the device as it relates to smoked products of different sizes. For one to smoke a pipe, cigar, or other non-standard sized cigarette product, for example, one would have to have a completely separate unit. Such an unnecessary expenditure greatly increases the cost of usage to the end consumer.

Ross, Jr.'s device also removes the mechanical actions to which smokers have become accustomed and which they derive pleasure from. Hence, by unnecessarily restricting the movement of the smoker, the device diminishes the smoker's enjoyment. One of the most pleasurable parts of smoking, to the smoker, is the tactile act itself: raising the cigarette to the lips, holding onto the cigarette, etc. Thereby, in removing these actions this device eliminates much of the pleasure derived from smoking and becomes uncomfortable and burdensome for the smoker to use.

The device in McCann's U.S. Pat. No. 4,993,435, issued Feb. 19, 1991, also fails to solve the problem of secondary-smoke. First and foremost, this device does not filter one-hundred percent of the secondary-smoke associated with the smoking of cigarettes. In operation, the cigarette must first be lit external to the device, and thereafter must be installed within the device. Therefore, some secondary-smoke, by necessity, escapes unfiltered. Further, this device has no flexibility whatsoever as it relates to forms of smoked products other than cigarettes, such as pipes and cigars. For instance, one would have to use two completely separate devices to smoke a cigarette and a cigar. This results in a higher cost of usage to the final consumer. Lastly, this device prevents the cigarette from being left unsmoked for extended periods of time without it being extinguished. Thereby, the possibility exists that the cigarette would have to be relit numerous times.

The device in Wallace's U.S. Pat. No. 4,790,332, issued Dec. 13, 1988, also has the disadvantage of an inability of having the cigarette lit within the device. The cigarette must first be lit external to the device, and then installed inside it. Thereby, it too fails to provide a means of eliminating the contamination of ambient air caused by cigarette smoking. Also there is no flexibility in regards to the usage of smoked products other than cigarettes, such as cigars or pipes. Finally, this device also eliminates the tactile motions to which the smoker is accustomed. In fact, the smoker does not even touch the cigarette directly after it has been installed.

OBJECTS AND ADVANTAGES

Accordingly, several objects and advantages of the present invention are:

(a) to provide a secondary-smoke filtration device which effectively filters one-hundred percent of the secondary-smoke associated with cigarettes, pipes, and cigars;

(b) to provide a secondary-smoke filtration device which enables smokers to freely enjoy smoking in public places;

(c) to provide a secondary-smoke filtration device which is portable, non-cumbersome, and relatively light-weight;

(d) to provide a secondary-smoke filtration device which is relatively simplistic to operate;

(e) to provide a secondary-smoke filtration device which enables ease of installation of the smoked product into the device without breakage or damage to the cigarette, pipe, or cigar;

(f) to provide a secondary-smoke filtration device which securely holds the smoked product in place during operation;

(g) to provide a secondary-smoke filtration device which enables flexibility in the use of different smoked products, such as cigarettes, pipes, and cigars, at minimal cost;

(h) to provide a secondary-smoke filtration device which enables the smoker to smoke using the movements and actions to which they are accustomed;

(i) to provide a secondary-smoke filtration device which does not greatly reduce the tactile pleasure smokers derive from smoking;

(j) to provide a secondary-smoke filtration device that enables the lighting of the smoked product to be accomplished within the confines of the device;

(k) to provide a secondary-smoke filtration device which enables the smoker to leave. The smoked product unattended for relatively extended periods of time without the cigarette, pipe, or cigar being extinguished;

(1) to provide a secondary-smoke filtration device which filters the odors associated with the smoke of cigarettes, pipes, and cigars;

(m) to provide a secondary-smoke filtration device which eliminates the discomfort which occurs when the eyes of the non-smoker, as well as the smoker, are irritated by the smoke of cigarettes, pipes, or cigars;

(n) to provide a secondary-smoke filtration device which can be manufactured economically;

(o) to provide a secondary-smoke filtration device which can be relatively easily maintained, cleaned, and repaired;

(p) to provide a secondary-smoke filtration device which acts as an ash collector;

(q) to provide a secondary-smoke filtration device with an extinguisher integral to the device; and (r) to provide a secondary-smoke filtration device which reduces the likelihood of fires or burns due to accidental contact with the exposed lighted ends of cigarettes, pipes, and cigars.

Further objects and advantages of my invention will become apparent from a consideration of the drawings and ensuing descriptions.

BRIEF DESCRIPTION OF THE DRAWING FIGURES

FIG. 1 is a perspective of the preferred embodiment of the present invention in its operational mode.

FIG. 2 is a side view of a smoked product container.

DETAILED DESCRIPTION

Figure 3:
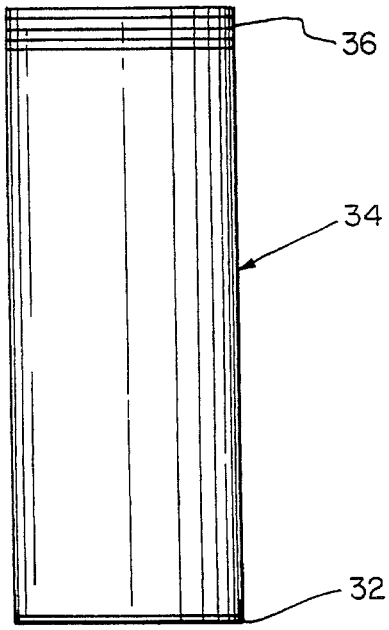
FIG. 3 is a side view of an exhalation pipe.

The present invention can be described by reference to the drawings.

The preferred embodiment of the present invention is illustrated in FIG. 1. A smoked product container 20 and an exhalation pipe 34 are connected to a filtering device 45 by a smoke conduit 30. A smoked product 10 is also shown in its installed position.

FIG. 2 shows a more detailed side view of the smoked product container 20. The smoked product container 20 is made of a tubular, smoke-impermeable, heat-resistant, rigid plexiglass, or similar material. Although its size will vary depending on the smoked product 10, in the case of a standard-sized cigarette the smoked product container 20 is approximately 10 cms. long and 0.8 cms. in diameter. These dimensions are also the approximate size of a standard cigarette. However, the smoked product container 20 is slightly larger in diameter from a hinge 15 to a smoked product container female threaded end 24. This tapered diameter is roughly 0.3 cms greater than the diameter of the smoked product container 20 from a latch fastener 12 to the hinge 15. A hinged opening 14 is located within the lesser diameter portion of the smoked product container 20. The hinged opening 14 is an integral part of the smoked product container 20 and opens at the hinge 15. The latch fastener 12, also integral to the smoked product container 20, is located at the end of the hinged opening 14, and is a simple locking clasp.

Beyond the hinge 15, in the larger diameter portion of the smoked product container 20 is an air hole 16. The air hole 16 is cut directly into the smoked product container 20 and is sufficiently large enough to provide adequate oxygen to keep the smoked product 10 lit. As FIG. 2 shows, there may be more than the one air hole 16. An air hole cover 18 is also connected to the smoked product container 20. It is made from rigid plastic and can be slid along the body of the smoked product container 20. It has a width equal to roughly twice the diameter of the air hole 16.

The smoked product container 20 also has a lighter opening 22 cut directly into it. The lighter opening 22 is approximately 1 cm. long and 0.8 cms. wide. A lighter opening cover 23, which is similar in nature to the air hole cover 18, can be slid along the body of the smoked product container 20, completely encircling it. The lighter opening cover 23 is approximately 2 cms. long. A lighter opening gasket 21, made of neoprene or similar material, is located around the perimeter of the lighter opening 22. At the end of the smoked product container 20 is the female threaded end 24. The female threaded end 24 is notched directly into the body of the smoked product container 20.

FIG. 3 shows the side view of the exhalation pipe 34. The exhalation pipe 34 is constructed of similar material as that of the smoked product container 20. The exhalation pipe 34 is approximately 10 cms. long and 0.8 cms in diameter. At one end there is an exhalation pipe tip 32, and on the other end is an exhalation pipe female threaded end 36. Both are formed directly into the body of the exhalation pipe 34.

Figure 4:
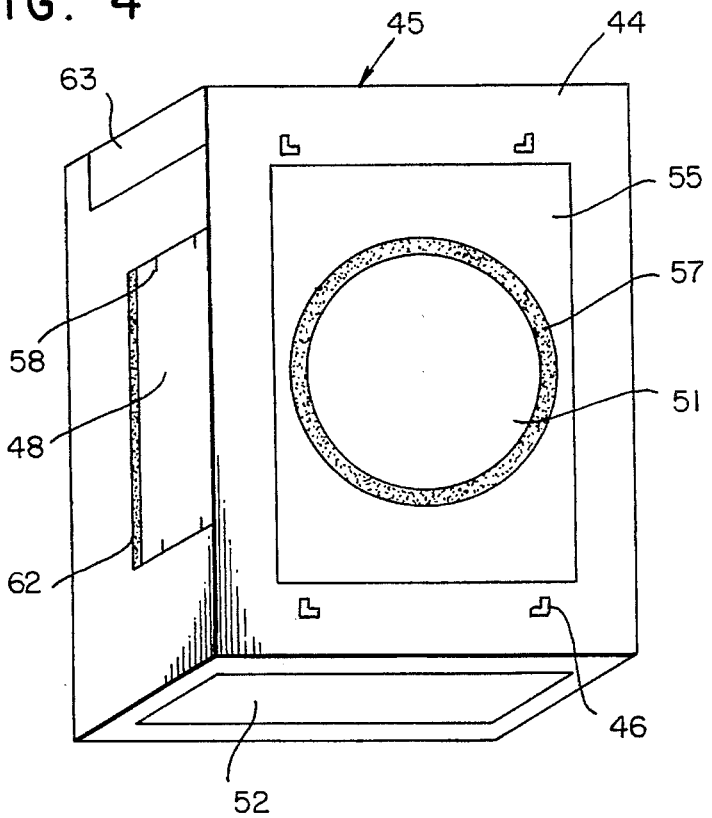
FIG.4 is a perspective of a filtering device in the open position.

FIG. 4 shows a perspective of the filtering device 45 in the open position. The filtering device 45 is comprised of a filtering device housing 44, a filter compartment 48, a battery compartment 63, a smoke conduit connector outlet 51, and an exhaust filter 52. It also includes a blower fan 64, shown in FIG. 6, and conventional electrical connections (not shown).

The filtering device housing 44 is simply the body around the various integral components of the filtering device 45. It is made of smoke-impermeable thermoplastic, or similar material. Although it could come in a variety of sizes, the preferred embodiment of the filtering device housing 44 is approximately 15 cms. high, by 10 cms. wide, by 6 cms. thick.

The filter compartment 48 is cut directly into the housing 44. Within the filter compartment 48 there are three rows of filter alignment guides 58 only two which are visible in FIG. 4. The guides 58 are constructed integrally into the housing 44. A filter compartment cover gasket 62, of neoprene or similar material, is also located around the perimeter of the filter compartment 48.

The battery compartment 63 is also cut directly into the housing 44. It is connected by conventional electrical connections (not shown).

The smoke conduit connector outlet 51 is also cut directly into the housing 44. It is approximately 1.5 cms. deep and 4 cms. in diameter. Around its perimeter there is a smoke conduit connector gasket 57 made of neoprene or similar material. A recessed indention 55 is also notched directly into the body of the housing 44 and is approximately 8 cms. wide by 8 cms. high by 0.2 cms deep. A stabilizer clip 46 is connected directly to the housing 44 outside the perimeter of the recessed indention 55. The clip 46, as shown in FIG. 4, showing a total of four clips 46, are built such that they are rotatable.

The exhaust filter 52 is located on the bottom side of the housing 44, and is built such that it can be snapped directly into and out of the housing 44.

The exhaust filter 52 is comprised of a plastic body surrounding a filter of material capable of capturing the contaminants of secondary-smoke. One skilled in the art would realize various materials could be used as the filter material.

Figure 5:
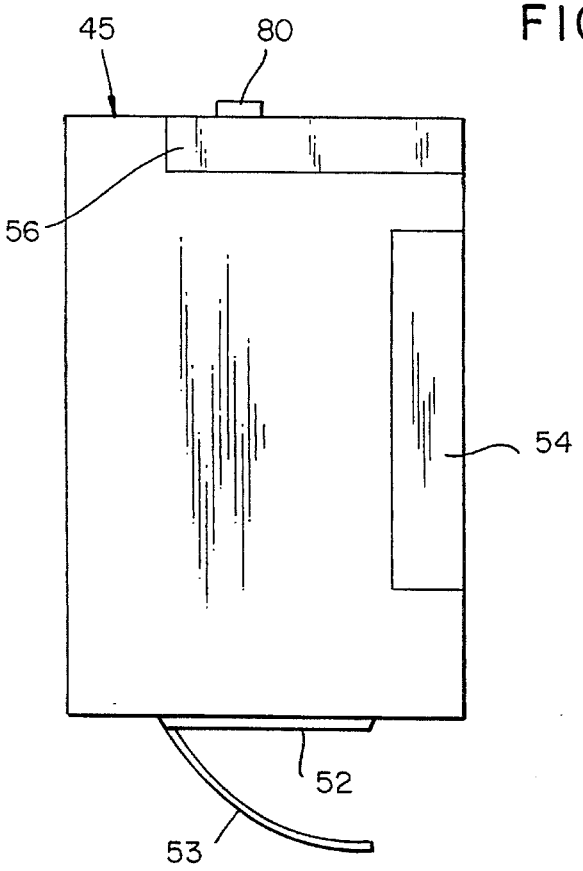
FIG. 5 is a side view of a filtering device.

FIG. 5 shows a side view of the filtering device 45, in the closed position. A battery compartment cover 56 slides flush into the body of the housing 44. A filter compartment cover 54 also slides flush into the body of the housing 44. An on-off variable speed switch 80 is shown on the top of the housing 44 and is connected to conventional electrical connections (not shown). The exhaust filter 52 is shown at the bottom of the housing 44. An exhaust directional blade 53 is also shown. The directional blade 53 is an optional accessory that slides directly into the body of the housing 44.

Figure 6:
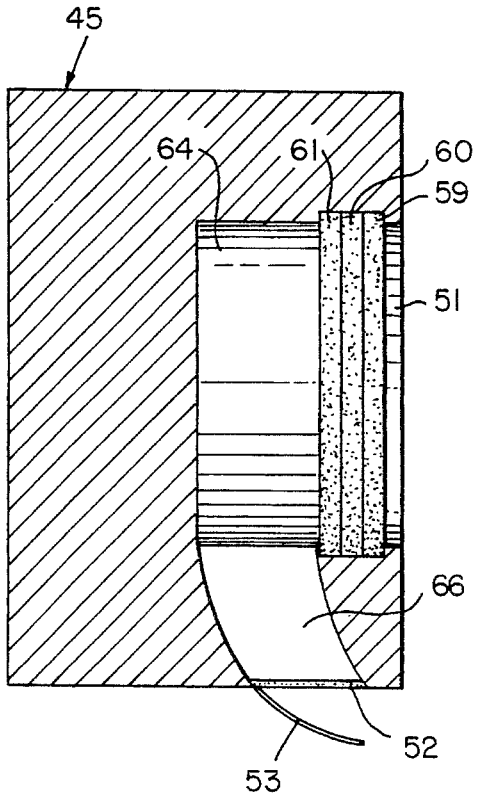
FIG. 6 is a side cutaway view of a filtering device.

FIG. 6 shows a side cutaway view of the filtering device 45. Directly behind the smoke conduit connector outlet 51 is a smoke filter A 59, a smoke filter B 60, and a smoke filter C 61. The filters 59, 60, and 61, respectively, are made of a plastic body surrounding a filter of material capable of capturing the contaminants of secondary-smoke. One skilled in the art would realize various materials could be used as the filter material. The filters 59, 60, and 61 slide directly into the filter compartment 48 through the filter alignment guides 58.

The blower fan 64 is located directly behind the filters 59, 60, and 61. The blower fan 64 is a squirrel-cage blower, or similar type fan, capable of producing a vacuum powerful enough to pull the secondary-smoke from the smoked product container 20 and the exhalation pipe 34, through the smoke conduit 30, and through the filters 59, 60, and 61. The blower fan 64 must also operate relatively quietly. One skilled in the art would recognize various types of fans could satisfy these conditions. The blower fan 64 is also constructed such that it blows out the air it has sucked in, in a downward direction, through an exhaust chute 66, which is connected between the body of the blower fan 64 and the housing 44.

Figure 7:
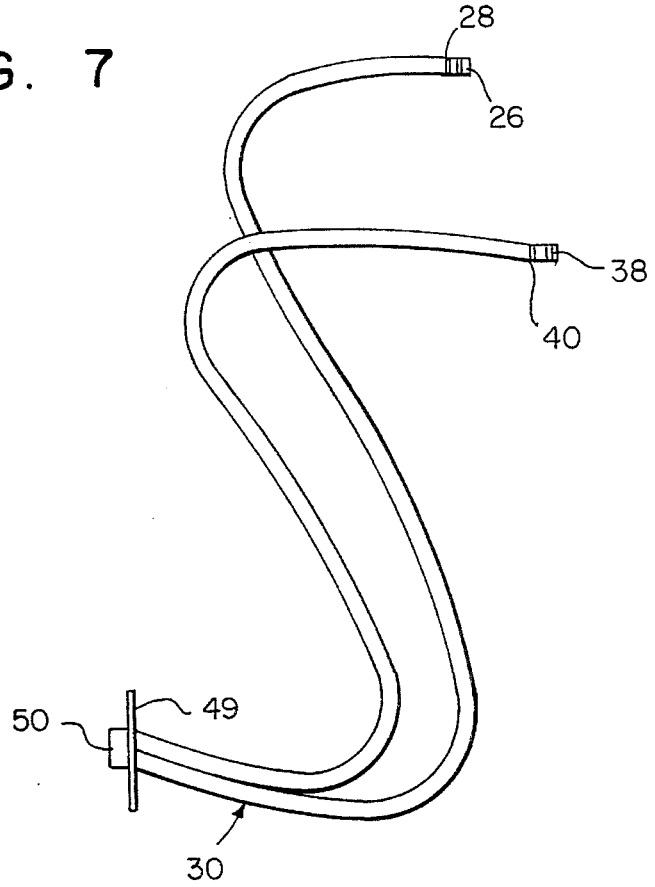
FIG. 7 is a perspective of a smoke conduit.

FIG. 7 shows a sidle view of the smoke conduit 30. The smoke conduit 30 is made of lightweight, smoke-impermeable plastic tubing, or similar material. At one end of the smoke conduit 30 is a smoked product container connector male threaded end 26. An ash barrier 28, made of wire mesh, or similar material, lies directly behind the male threaded end 26 and is an integral part of the smoke conduit 30.

At the other end of the smoke conduit 30 is an exhalation pipe connector male threaded end-38. A foreign matter barrier 40, made of wire mesh or similar material, lies directly behind the male threaded end 38 and is an integral part of the smoke conduit 30. The size of-both the male threaded end 26 and the male threaded end 38 corresponds exactly to the sizes of the female threaded end 24 and the female threaded end 36, respectively. At the opposite end of the smoke conduit 30 is a smoke conduit connector plug 50. The plug 50 is rounded in shape and constructed integrally to the smoke conduit 30. It is approximately 1.5 cms. deep and 4 cms. in diameter, which corresponds to the dimensions of the outlet 51. A smoke conduit connector plug outer body 49 is built integrally around the plug 50. The outer body 49 is approximately 8 cms. wide by 8 cms. high by 0.2 cms. deep, which corresponds to the dimensions of the recessed indention 55.

Figure 8:
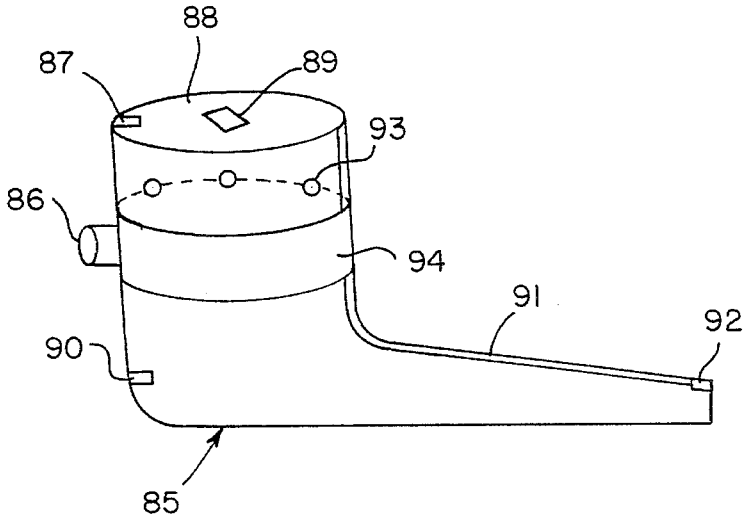
FIG. 8 is a perspective of the embodiment of a smoked product container for use with a pipe.

FIG. 8 shows a top view of the embodiment of a pipe container 85. The pipe container 85 is similar in design and construction to the smoked product container 20. A pipe container female threaded end 86 is built integrally into the pipe container 85. At the top side of the pipe container 85 is a pipe container top cover hinge 87 and a pipe container top cover 88. A pipe container lighter opening 89 is located within the cover 88, and is constructed of a void with a spring-hinged cover.

The pipe container 85 also has a pipe container hinge 90, of which there can be a plurality, and a pipe container hinged opening 91, which is similar to the hinged opening 14 of the smoked product container 20. A pipe container latch fastener 92 is located at the end of the hinged opening 91. The pipe container 85 also has a pipe container air hole 93, drilled directly into the body of the pipe container 85, sufficiently large enough to provide adequate oxygen to keep the smoked product 10, in this case a pipe, lit. A pipe container air hole cover 94, similar to thee air hole cover 18 of the smoked product container 20, is also constructed around the body of the pipe container 85.

OPERATION

The operation of the preferred embodiment of the present invention is illustrated by FIGS. 1, 4, 5, 6, 7, and 8. Before operation, however, certain procedures must be performed to prepare the present invention for usage, as it is shown in FIG. 1.

First, the smoked product 10 must be installed into the smoked product container 20. This is done by opening the hinged opening 14 at the hinge 15, inserting the smoked product 10 inside the smoked product container 20 such that approximately 2 cms. of the tip end of the smoked product 10 sticks out, and then closing the hinged opening 14 tightly around the smoked product 10. The latch fastener 12 is then engaged thereby locking the hinged opening 14 in the closed position. This action creates a mechanical gasket between the smoked product 10 and the smoked product container 20. This procedure would be the same regardless of whether the smoked product 10 is a cigarette, a pipe, or a cigar.

The filters 59, 60, and 61 must also be installed. This task is accomplished by opening the filter compartment cover 54 and sliding the filters 59, 60 and 61 into the filter compartment 48, through the filter alignment guides 58. The alignment guides 58 ensure the filters 59, 60, and 61 are properly installed. The filter compartment cover 54 is then closed. The filter compartment cover gasket 62 creates a gasketed seal between the filter device housing 44 and the filter compartment cover 54, thereby eliminating the possibility of unfiltered secondary smoke escaping into the environment.

The smoke conduit 30 must also be installed. This is done by inserting the smoke conduit connector plug 50 into the smoke conduit connector outlet 51. The smoke conduit connector gasket 57 creates a gasketed seal between the plug 50 and the filtering device housing 44, thereby eliminating the possibility of unfiltered secondary smoke escaping into the environment. The smoke conduit connector plug outer body 49 is positioned within the recessed indention 55. The stabilizer clips 46 are then rotated to tightly rest on top of the outer body 49, thereby securely connecting the smoke conduit 30 to the filtration device 45.

Finally, the smoked product container connector male threaded end 26 must be screwed into the smoked product container female threaded end 24. The exhalation pipe connector male threaded end 38 must also be screwed into the exhalation pipe female threaded end 36. With these tasks completed, the present invention is operational.

In usage, the smoker lights the smoked product 10 by opening the lighter opening cover 23 and, through the use of a match or lighter (not shown), ignites the smoked product 10 through the lighter opening 22. The lighter opening cover 23 is then returned to a position completely covering the lighter opening 22. The lighter opening gasket 21 then creates a gasketed seal between the lighter opening cover 23 and the smoked product container 20, thereby eliminating the possibility of unfiltered secondary smoke escaping into the environment. The air hole cover 18 must be positioned such that oxygen is provided to the now-lit smoked product 10, through the air hole 16.

The smoker now inhales smoke from the tip of the smoked product 10 while holding the smoked product container 20. The ash barrier 28 prevents any ashes or remnants of the burning smoked product 10 from entering into the smoke conduit 30. When wishing to exhale, the smoker simply raises the exhalation pipe 34 to his or her lips and blows into the pipe 34. The exhalation pipe tip 32 is built to ease this exhalation process and to add to the comfort of the smoker. The foreign matter barrier 40 prevents any unwanted material from entering the smoke conduit 30. Thereby, both the smoke from the lit end of the smoked product 10 and the smoke exhaled into the exhalation pipe 34 are delivered to the conduit.

The blower fan 64 then draws the secondary smoke through the smoke conduit 30 to the filtering device 45. Upon entering the filtering device 45, the smoke is drawn through the filters 59, 60, and 61. The filters 59, 60, and 61 filter the contaminants of the secondary-smoke, including carcinogenic agents and odor-causing agents. The blower fan 64 then pulls the smoke into its fan and thereafter expulses the now filtered, pollutant-free smoke through the exhaust chute 66, and through the exhaust filter 52, which acts as a final filtration stage. The smoke is thereby returned to the environment completely filtered. The optional exhaust directional blade 53 can be used in this process to direct the smoke once it is returned to the environment. The filtering device housing 44 acts simply to contain all component parts of the filtering device 45, including the battery compartment 63, the battery compartment cover 56, and the on-off variable speed switch 80, which is used to control the blower fan 64.

The smoker continues this same inhalation/exhalation process until finished smoking. When he/she is finished, the smoker simply extinguishes the smoked product 10 by covering the air hole 16 with the air hole cover 18. After the smoked product 10 is extinguished, the smoker removes it from the smoked product container 20 by unfastening the fastener 12 and opening the hinged opening 14. The remnants of the smoked item 10 can then be discarded into a proper receptacle by unscrewing the female threaded end 24 from the male threaded end 26 of the smoke conduit 30.

Although either a cigarette, pipe, or cigar can be smoked using the present invention by simply adjusting the size of the smoked product container 20, the form of a pipe necessitates the embodiment of the pipe container 85, shown in FIG. 8. Although very similar in operation and spirit to the smoked product container 20, an explanation of its use is needed.

The smoke conduit 30 is connected to the pipe container 85 by the mating of the male threaded end 26 and the pipe container female threaded end 86. The smoked product 10, in this case a pipe, is installed into the pipe container 85 by opening the pipe container hinged opening 91 at the pipe container hinge 90. The hinged opening 91 is then closed tightly around the smoked product 10 and locked at the pipe container latch fastener 92. The smoked product 10 is then lit by placing an igniting instrument (not shown), through the pipe container lighter opening 89. The pipe container top cover 88 and the pipe container top cover hinge 87 facilitate the installation of the smoked product 10 as well as the re-tobaccoing of the smoked product 10 while still installed. The pipe container air hole 93 and the pipe container air hole cover 94 serve the same function as the air hole 16 and the air hole cover 18.

SUMMARY RAMIFICATIONS AND SCOPE

Thusly, the reader will see that the secondary-smoke filtration device can be comfortably and conveniently used by smokers to eliminate the problem of secondary-smoke.

While my above description contains many specificities, these should not be construed as limitations on the scope of the invention, but rather as an exemplification of one preferred embodiment thereof. Many other variations are possible. For example, another embodiment of the present invention could utilize a combined smoked product container 20 and exhalation pipe 34. In this case, the exhalation pipe 34 would be formed around the body of the smoker product container 20, or connected side by side to one another.

Another embodiment of the present invention could allow for many smoke conduits 30, and thereby would allow a plurality of smokers to utilize the single filtering device 45.

Another embodiment of the present invention could include an integral lighting device (not shown) as a component of the smoked product container 20. Thereby the lighter opening 22, the lighter opening cover 23, and the lighter opening gasket 21, could be eliminated.

Accordingly, the scope of the invention should be determined not by the embodiment illustrated, but by the appended claims and their legal equivalents.

I claim:

1. A secondary smoke filtration device for containing and filtering smoke associated with the use of a smoking product, comprising (a) first container means for receiving and retaining a smoking product, said first container means having an opening at one end through which an inhalation end of the smoking product protrudes for inhalation by a user, said first container means completely enclosing a burning end of the smoking product to capture secondary smoke emanating from the burning end;

(b) second container means separate and distinct from said first container means for receiving secondary smoke exhaled by the user, said second container means having a generally cylindrical configuration and being adapted for insertion between the user's lips in contiguous relation therewith to prevent exhaled smoke from entering the environment;

(c) a first flexible tube connected with said first container means for receiving secondary smoke from the smoking product;

(d) a second flexible tube separate and distinct from said first flexible tube and connected with said second container means for receiving secondary smoke from the user; and (e) filter means connecting with said first and second flexible tubes, said filter means including (1) at least one filter member for removing contaminants from the secondary smoke; and (2) blower means for drawing secondary smoke from said first and second flexible tubes through said filter member and for dispersing filtered smoke to the environment.

2. A device as defined in claim 1, wherein said container means, said exhalation means, and said conduit means are formed of smoke impermeable material, whereby all of the secondary smoke from the burning end of the smoking product and exhaled from the user is delivered to said filter means.

3. A device as defined in claim 2, wherein said conduit tubes include a foreign matter barrier adjacent to said exhalation means to prevent particulates from the exhaled secondary smoke from being drawn into said filter means.

4. A device as defined in claim 2, wherein said filter means comprises a housing containing said filter member and said blower means.

5. A device as defined in claim 4, wherein said filter housing contains a plurality of filter guides for supporting a plurality of filters in parallel contiguous relation adjacent to said blower means.

6. A device as defined in claim 5, wherein said filter housing further contains a battery for operating said blower means.

7. A secondary smoke filtration device for containing and filtering smoke associated with the use of a smoking product, comprising (a) first container means for receiving and retaining a smoking product, said first container means having an opening at one end through which an inhalation end of the smoking product protrudes for inhalation by a user, said first container means including at least a pair of sections connected together via a hinge and means for latching said sections together in a closed and sealed position to completely enclose a burning end of the smoking product to capture secondary smoke emanating from the burning end, whereby said first container means may be opened to remove a spent smoking product and to insert a new smoking product;

(b) second container means separate and distinct from said first containers means for receiving secondary smoke exhaled by the user, said second container means having a generally cylindrical configuration and being adapted for insertion between the user's lips in contiguous relation therewith to prevent exhaled smoke from entering the environment;

(c) conduit means including first and second separate and distinct flexible tubes removably connected with said first and second container means, respectively, for receiving secondary smoke from said smoking product and from the user, said first tube including an ash barrier adjacent to said first container means to prevent ashes from said smoking product from being transported through said tube; and (d) filter means connected with said conduit means, said filter means including (1) at least one filter member for removing contaminants from the secondary smoke; and (2) blower means for drawing secondary smoke from said conduit means through said filter member and for dispersing filtered smoke to the environment.

8. A device as defined in claim 7, wherein said container means includes at least one air hole to enable ambient air to enter said container means to support burning of the smoking product.

9. A device as defined in claim 8, wherein said container means includes first cover means for covering said air hole to extinguish the smoking product.

10. A device as defined in claim 9, wherein said container means includes a lighter opening for igniting the smoking product and second cover means for covering said lighter opening.

* * * * *